US007240452B2

(12) United States Patent
Ho

(10) Patent No.: US 7,240,452 B2
(45) Date of Patent: Jul. 10, 2007

(54) STRUCTURE FOR FIXING A GUN SCOPE

(76) Inventor: Shu-Li Ho, 11F, No. 13-3, Alley 97, Lane 110, Hucian St., Sijhih City, Taipei County 221 (TW)

( * ) Notice: Subject to any disclaimer, the term of this patent is extended or adjusted under 35 U.S.C. 154(b) by 0 days.

(21) Appl. No.: 11/285,031

(22) Filed: Nov. 23, 2005

(65) Prior Publication Data

US 2007/0113462 A1 May 24, 2007

(51) Int. Cl.
*F41G 1/38* (2006.01)

(52) U.S. Cl. ..... 42/124; 42/127

(58) Field of Classification Search ..... 42/124, 42/125, 126, 127, 128, 146, 111, 85; 362/110, 362/112

See application file for complete search history.

(56) References Cited

U.S. PATENT DOCUMENTS 4,905,396 A * 3/1990 Bechtel ..... 42/127
6,574,901 B1 * 6/2003 Solinsky et al. ..... 42/146
7,117,624 B2 * 10/2006 Kim ..... 42/85
2002/0100204 A1 * 8/2002 Kim ..... 42/146
2005/0246937 A1 * 11/2005 Kim ..... 42/146
2005/0257415 A1 * 11/2005 Solinsky et al. ..... 42/146
2005/0279004 A1 * 12/2005 Woodmansee et al. ..... 42/146
2006/0010759 A1 * 1/2006 Penney ..... 42/126

* cited by examiner

*Primary Examiner*—Michelle Clement
*Assistant Examiner*—Benjamin P Lee
(74) *Attorney, Agent, or Firm*—Rosenberg, Klein & Lee

(57) ABSTRACT

A structure for fixing a scope includes a fixing base, a rotatable disk, a locking bolt, and two elastic components. The fixing base is departably attached to the gun. The rotatable disk is rotatably disposed at a bottom of the fixing base and has a screw bolt disposed on its center. The locking bolt is disposed within the containing room and capable of being moved upward or downward. The locking bolt has a screw hole formed on its center and the screw bolt is screwed into the screw hole. When the rotatable disk is rotated in a first direction, the screw bolt is used to push the locking bolt upward into the fixing slot of the gun. When the rotatable disk is rotated in a second direction, the locking bolt is pushed downward by the two elastic components and thus disconnected from the fixing slot of the gun.

6 Claims, 6 Drawing Sheets

STRUCTURE FOR FIXING A GUN SCOPE

BACKGROUND OF THE INVENTION

1. Field of the Invention

The present invention is related to a structure for fixing a gun scope, and more particularly, to a structure that is used to attach a scope to a gun. Compared with the prior art, the structure of the present invention has a better fixing capability and is more easily attached to or detached from a gun.

2. Description of Related Art

Conventional scopes, such as laser scopes, can be attached to guns. Light emitted from the scopes helps people to aim at a target. The scope needs to be attached to the barrel of a gun by a proper fixing structure.

Reference is made to FIG. 1 that shows a conventional scope 8 attached to a gun by a fixing structure. The fixing structure 9 includes a fixing base 91, a rotatable disk 2, and a locking bolt 93. The rotatable disk 92 pivots at the bottom of the fixing base 91 and projects from two sides of the fixing base 91. Hence, the user can use their fingers to rotate the rotatable disk 92. The top of the rotatable disk 92 has two wedge-shaped components 921 projecting therefrom. The locking bolt 93 is disposed inside the fixing base 91 and can be moved upward or downward. The tops of the two wedge-shaped components 921 contact a lower end of the locking bolt 93. In this way, the two wedge-shaped components 921 can be used to control the locking bolt 93 so that it can be moved upward or downward.

The scope 8 can be attached to a gun (not shown) by the two directing tracks 911 formed on the top of the fixing base 91 of the fixing structure 9. Rotating the rotatable disk 92 allows the locking bolt 93 to be moved towards the higher ends of the two wedge-shaped components 921. In this way, the locking bolt 93 can be moved upward to a higher position and pushed into corresponding fixing slots (not shown) of the gun. Also the scope 8 can be fixed on the barrel of the gun.

When the rotatable disk 92 is rotated in the opposite direction, the locking bolt 93 is moved towards the lower ends of the two wedge-shaped components 921 due to gravity. In this way, the locking bolt 93 is moved downward to a lower position and departs from the fixing slots of the gun. Thus, the scope 8 can be detached from the gun.

However, in the above-mentioned fixing structure 9, the locking bolt 93 is moved upward by the two wedge-shaped components 921 of the rotatable disk 92 to make the fixing structure 9 attach to the gun. Since there is no fixing mechanism provided between the two wedge-shaped components 921 and the locking bolt 93, the relative movement occurs easily. Hence, it is difficult to fix the locking bolt firmly in the fixing slots of the gun and the scope 8 is thus easily moved from its original position. Especially, when a shot is fired, the recoil of the gun is usually very large and the movement of the scope 8 occurs even more easily.

Furthermore, when one wants to detach the scope 8 from the gun, the locking bolt 93 is moved to the lower position by gravity. Since the locking bolt 93 may be stuck due to friction or other reasons it cannot be moved downward, so it is often difficult to detach the scope 8 from the gun quickly.

Accordingly, as discussed above, the prior art still has some drawbacks that could be improved upon. The present invention aims to resolve the drawbacks of the prior art.

SUMMARY OF THE INVENTION

An objective of the present invention is to provide a structure for fixing a scope to a gun. Therein, the rotatable disk of the fixing structure has a screw bolt projecting therefrom. The screw bolt is screwed into a corresponding screw hole of the locking bolt. The locking bolt can be moved upward or downward by using the screw bolt. Thus, the locking bolt can be fixed at a predetermined position firmly. In this way, the locking bolt can be securely fixed on the gun. Moreover, the locking bolt 33 can be pushed downward via two elastic components. In this way, the locking bolt can be disconnected from the fixing slots of the gun surely and quickly. Thus, the scope can be detached from the gun quickly.

For achieving the objective above, the present invention provides a structure for fixing a scope on a gun. In other words, the fixing structure is used for attaching the scope to the gun. Therein, the gun has a fixing slot. The fixing structure includes a fixing base, a rotatable disk, a locking bolt, and two elastic components. The fixing base is disposed fixedly on a top of the scope and has a containing room. Therein the fixing base is departably attached to the gun. The rotatable disk is rotatably disposed at a bottom of the fixing base and has a screw bolt disposed on a center thereof. The locking bolt is disposed within the containing room of the fixing base and capable of being moved upward or downward. The locking bolt has a screw hole formed on a center thereof and the screw bolt is screwed into the screw hole. The two elastic components are disposed between the fixing base and the locking bolt. Therein, when the rotatable disk is rotated in a first direction, the screw bolt pushes the locking bolt upward into the fixing slot of the gun. When the rotatable disk is rotated in a second direction, the locking bolt is pushed downward by the two elastic components and thus disconnected from the fixing slot of the gun.

Numerous additional features, benefits and details of the present invention are described in the detailed description, which follows.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1:
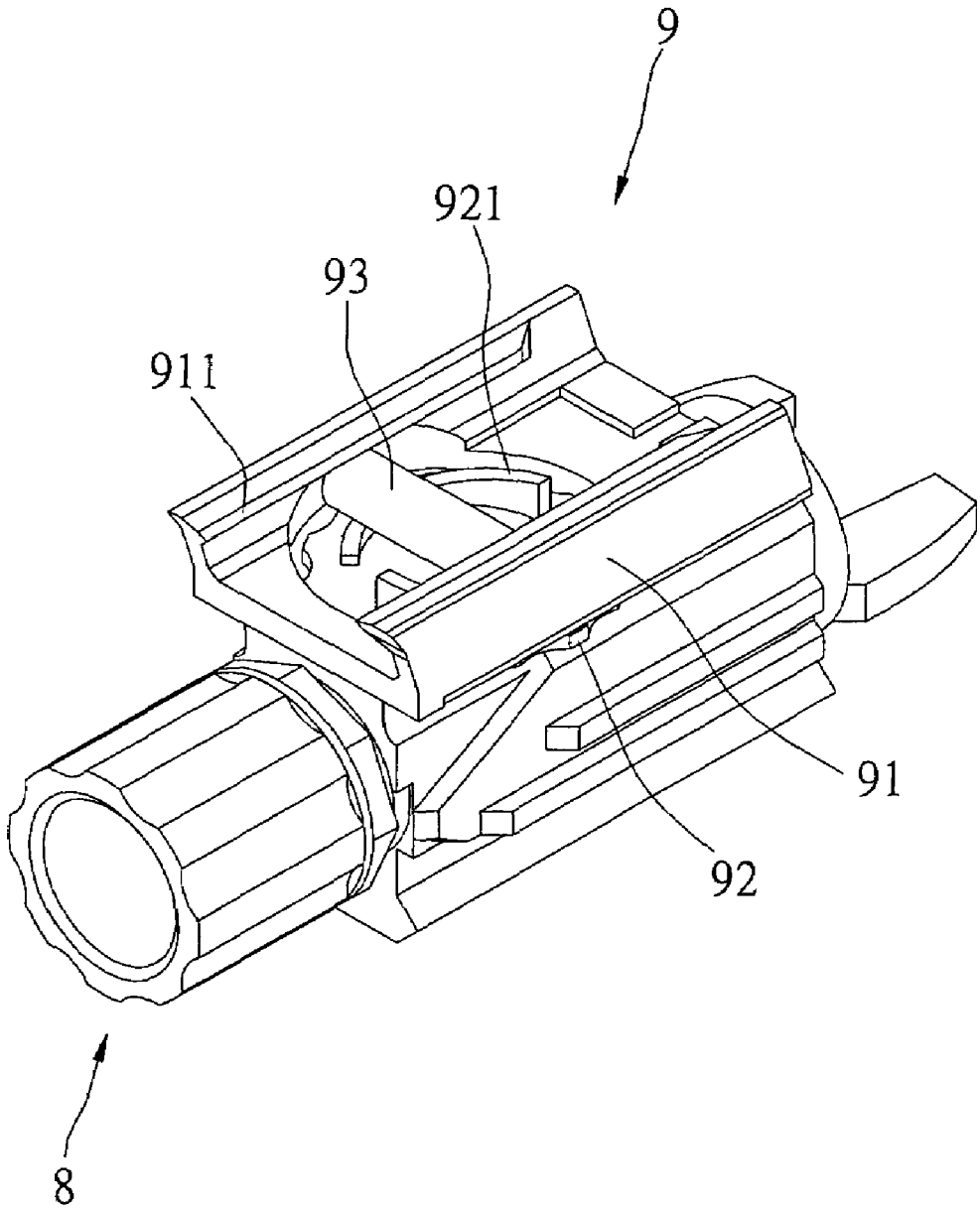
FIG. 1 PRIOR ART
FIG. 1 is schematic diagram of a conventional structure for fixing a scope on a gun.
Figure 2:
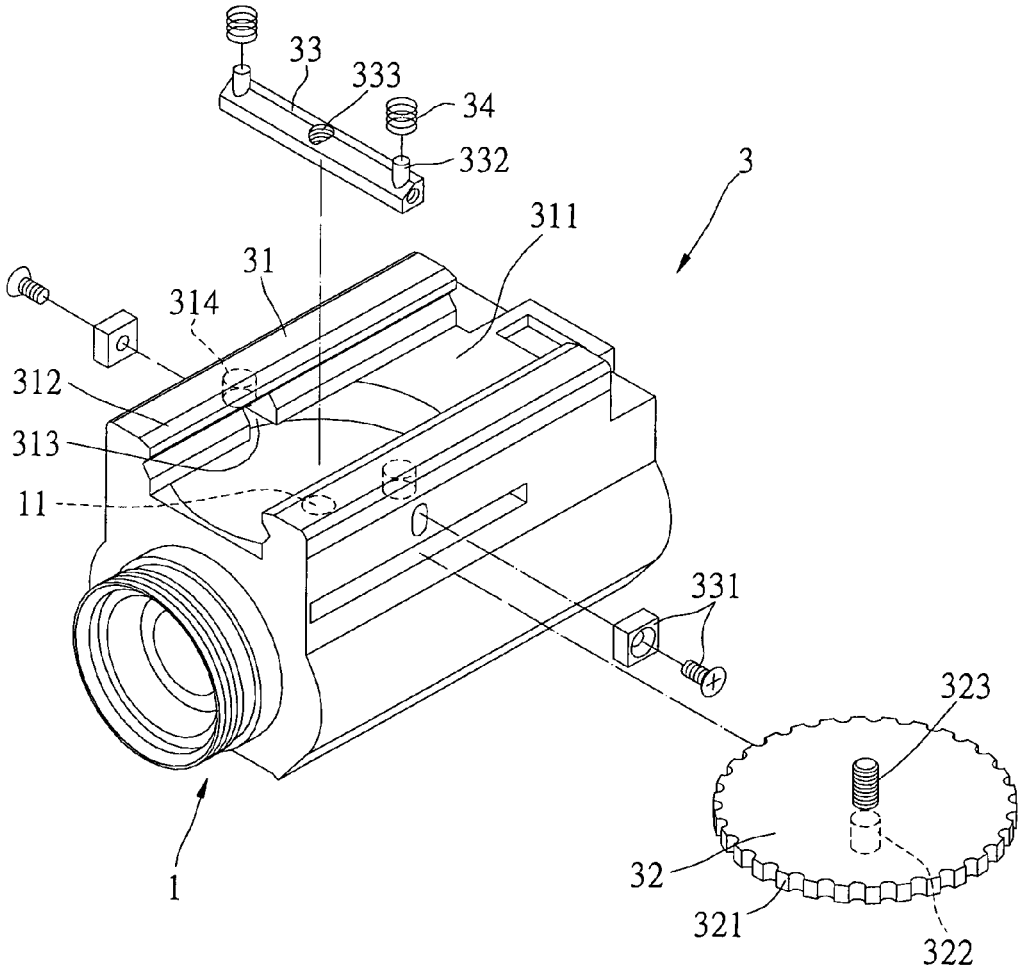
FIG. 2 is an exploded view of the present invention.
Figure 3:
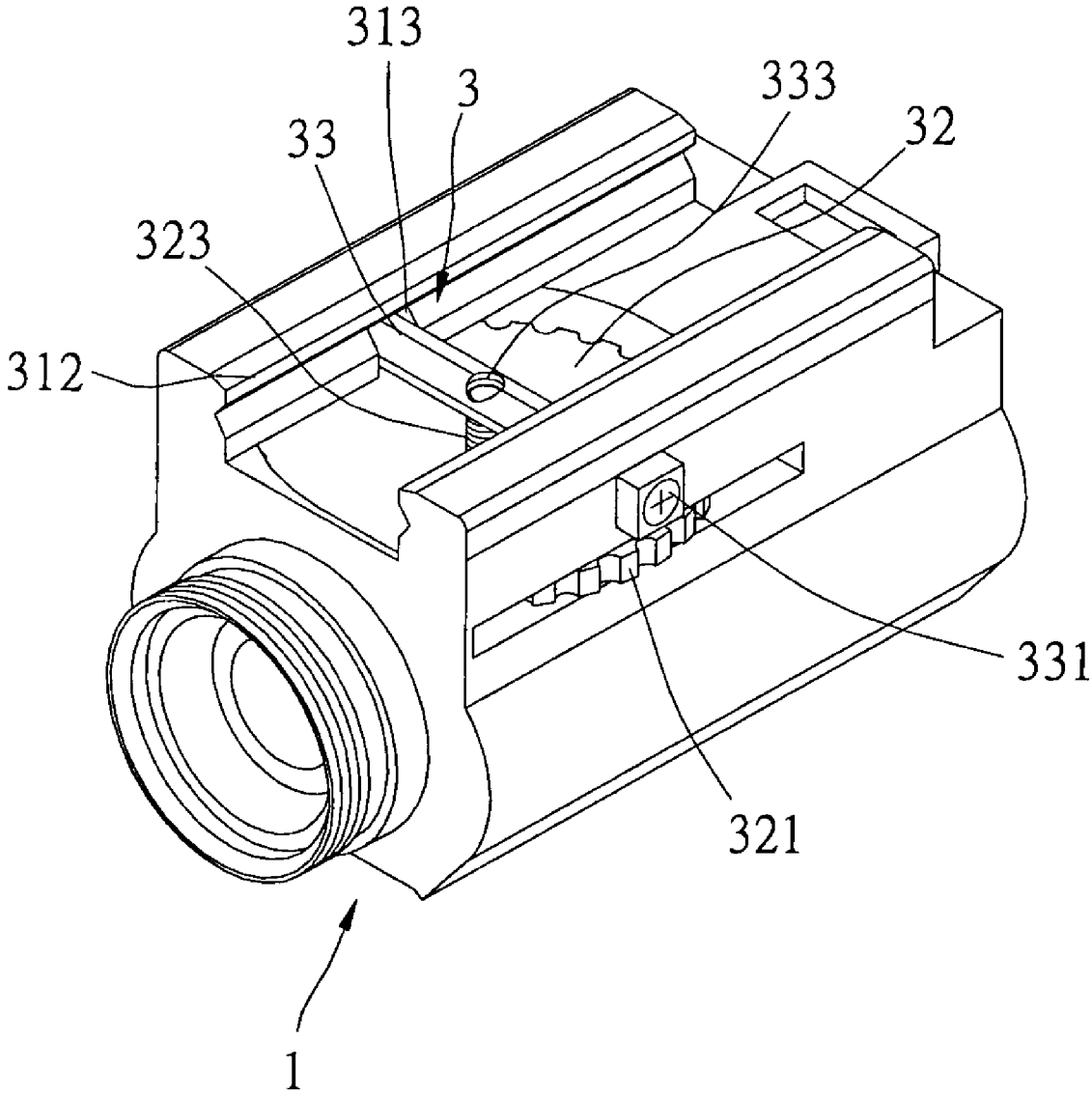
FIG. 3 is a combined view of the present invention.
Figure 4:
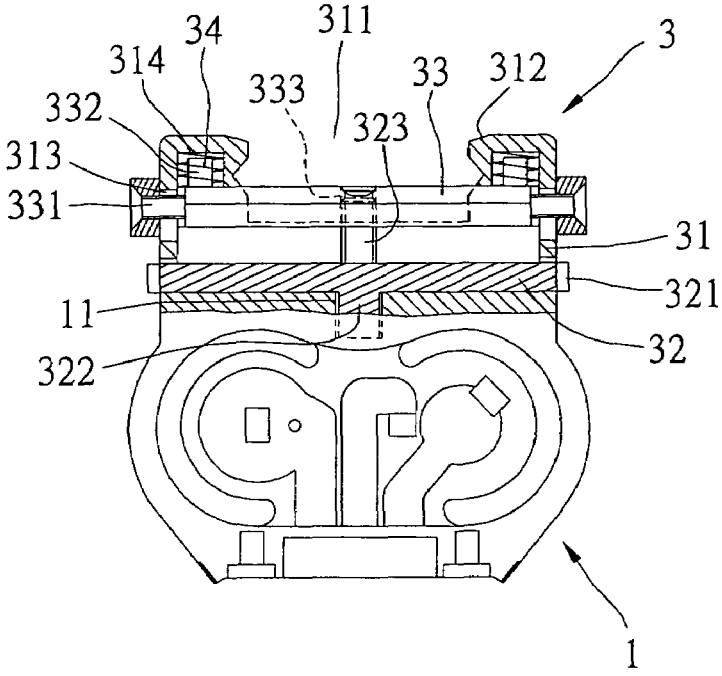
FIG. 4 is a front cross-sectional view of the present invention.
Figure 5:
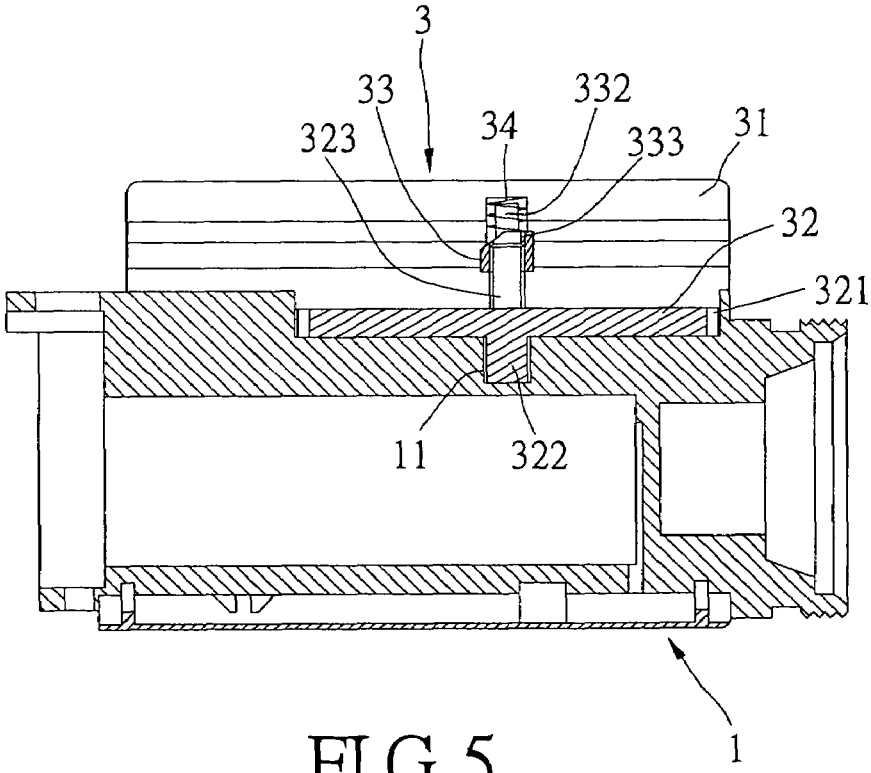
FIG. 5 is a lateral cross-sectional view of the present invention.
Figure 6:
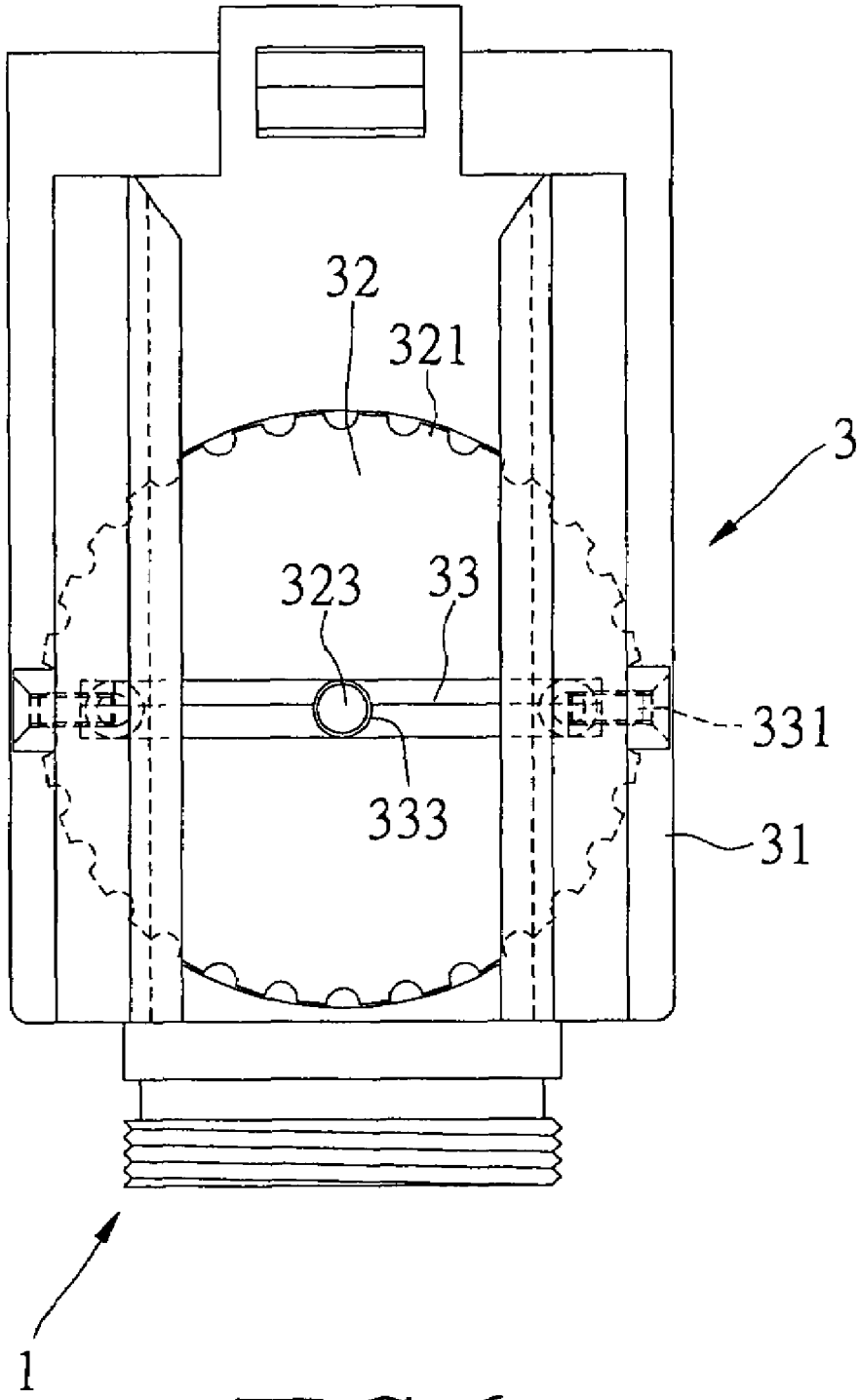
FIG. 6 is a top view of the present invention.
Figure 7:
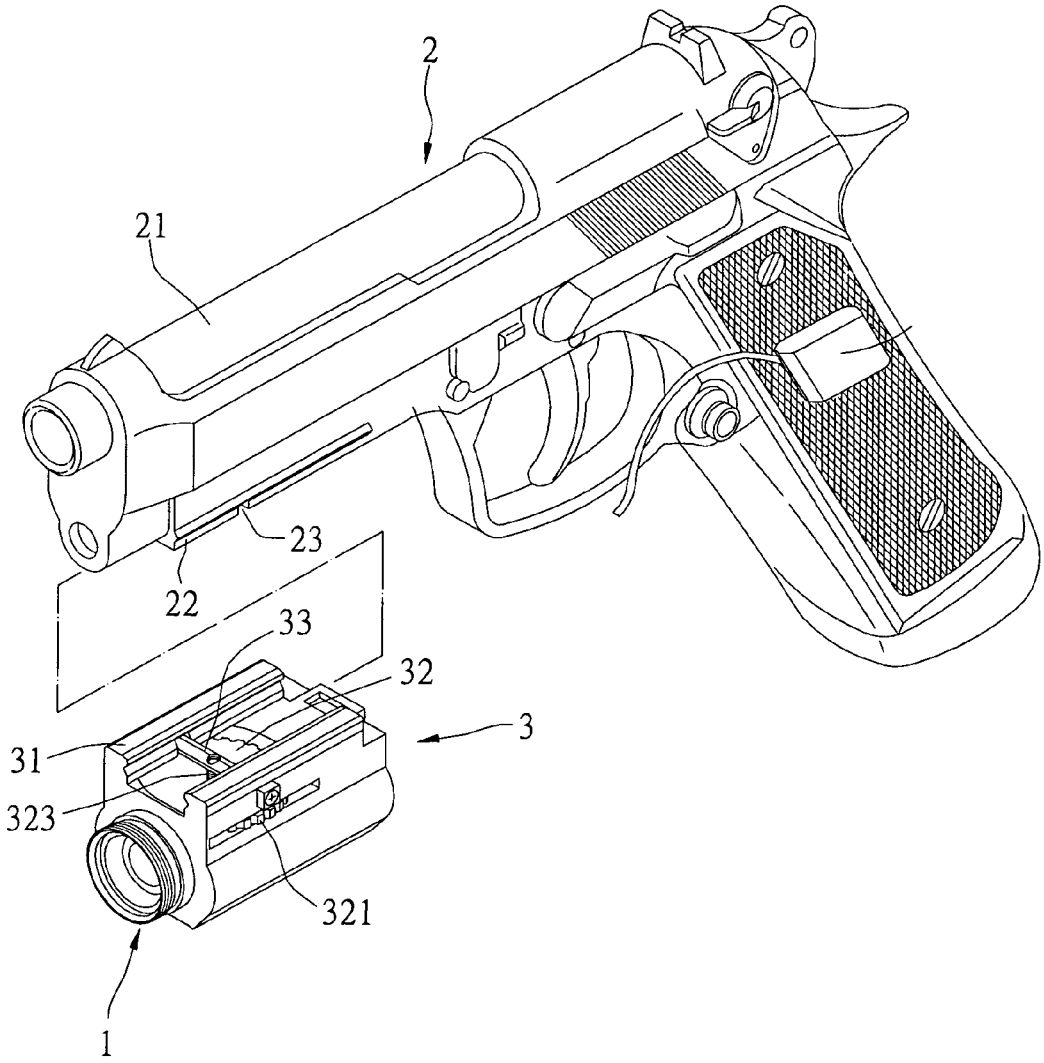
FIG. 7 is an elevation view for showing how the scope is attached to the gun using the fixing structure of the present invention.

Reference is made to FIGS. 2-7, which show a structure for fixing a scope on a gun in accordance with the present invention. As shown in these figures, a fixing structure 3 is used for attaching a scope 1 to a gun 2. The fixing structure is located between the scope 1 and the gun 2 when completely and fully attached. The fixing structure 3 includes a fixing base 31, a rotatable disk 32, a locking bolt 33, and two elastic components 34. Therein, the fixing base 31 is fixed on the top of the scope 1. A containing room 311 is formed on the top of the fixing base 31. The containing room 311 has openings on its top, front end, and rear end for containing the rotatable disk 32 and the locking bolt 33. The containing room 311 has a pair of first directing tracks 312 formed at two sides thereof. The fixing base 31 can be attached to the bottom of the barrel 21 of the gun 2 by using a pair of second directing tracks 22 corresponding to the first directing tracks 31. The second directing tracks 22 are formed along the barrel 21. Hence, the fixing base 31 and the scope 1 can be attached to the gun 2 along the barrel 21.

The rotatable disk 32 is round and has multiple indentations 321 formed periodically thereon. Due to the indentations 321, one can rotate the rotatable disk 32 easily. The bottom of the rotatable disk 32 has a shaft 322 projecting from its center. The shaft 322 is placed in a corresponding pivotal hole 11 formed on the top of the scope 1. In this way, the rotatable disk 32 is disposed rotatably between the bottom of the fixing base 31 and the top of the scope 1. The outer edge of the rotatable disk 32 projects from two sides of the fixing base 31. Hence, one can easily rotate the rotatable disk 32. The top of the rotatable disk 32 has a screw bolt 323 projecting from its center.

The locking bolt 33 is a rectangular parallelepiped substantially. It is disposed horizontally in the containing room 311 of the fixing base 31. The two ends of the locking bolt 33 connect respectively to two sliding components 331. The containing room 311 of the fixing base 31 has two sides formed with sliding slots 313. The sliding components 331 connecting to the two ends of the locking bolt 33 are disposed within the sliding slots 313 and can be moved upward or downward therein. In this way, the locking bolt 33 is disposed within the containing room 311 of the fixing base 31 and can be moved upward or downward therein. The middle of the locking bolt 33 has a screw hole 333 formed thereon and the screw bolt 323 of the rotatable disk 32 is screwed into the screw hole 333.

The two elastic components 34 are springs and respectively slip on two poles 332 projecting from the upper portion of the two ends of the locking bolt 33. The elastic components 34 are located between the fixing base 31 and the locking bolt 33. The lower ends of the elastic components 34 are placed on the upper portions of the locking bolt 33 while the upper ends of the elastic components 34 abut against tops of depressions 314 formed on the fixing base 31 respectively. The elastic components 34 are used to push the locking bolt 33 downward.

The bottom of the barrel 21 of the gun 2 has fixing slots 23. The fixing slots 23 are formed vertical to the barrel 21. The scope 1 is attached to the barrel 21 of the gun 2 by using the first directing tracks 312 together with the second directing tracks 22. When the scope 1 is placed in the predetermined position, one can rotate the rotatable disk 32 to make the locking bolt 33 move upward via the mechanism of the screw bolt 323 and the screw hole 333. Thereby, the locking bolt 33 can be pushed into the fixing slots 23 of the gun 2. In this way, the scope 1 can be attached to the barrel 21 of the gun 2 quickly.

When one wants to detach the scope 1 from the gun 2, the user only needs to rotate the rotatable disk 23 in the opposite direction. Rotating the rotatable disk 23 makes the locking bolt 33 move downward via the mechanism of the screw bolt 323 and the screw hole 333. In this way, the locking bolt 33 is disconnected from the fixing slots 23 of the gun 2 and thereby the scope 1 can be detached from the gun 2 quickly.

In the present invention, the rotatable disk 32 has a screw bolt 323 projecting therefrom. The screw bolt 323 is screwed into the screw hole 333. Via the mechanism of the screw bolt 323 and the screw hole 333, the locking bolt 33 can be moved upward or downward. Thus, the locking bolt 33 can be fixed at a predetermined position firmly by the screw mechanism. In this way, the locking bolt 33 is securely fixed on the gun 2 and movement of the scope 1 is prevented when completely and fully attached.

Moreover, the two elastic components 34 are disposed between the locking bolt 33 and the fixing base 31. When one wants to detach the scope 1 from the gun 2, the user only needs to rotate the rotatable disk 32 in the opposite direction to make the screw bolt 323 drive the locking bolt 33 to move downward. At this time, the locking bolt 33 is also pushed downward by the two elastic components 34. In this way, the locking bolt 33 can be disconnected from the fixing slots 23 of the gun 2 surely and quickly. Thus, the scope 1 can be detached from the gun 2 quickly.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are embraced within the scope of the invention as defined in the appended claims.

What is claimed is:

1. A structure for fixing a scope on a gun, the fixing structure being used for attaching the scope to the gun, the gun having a fixing slot, the fixing structure comprising:

a fixing base disposed fixedly on a top of the scope and formed with a containing room, wherein the fixing base is departably attached to the gun;

a rotatable disk rotatably disposed at a bottom of the fixing base and having a screw bolt disposed on a center thereof;

a locking bolt disposed within the containing room of the fixing base and capable of being moved upward or downward, the locking bolt having a screw hole formed on a center thereof, and the screw bolt being screwed into the screw hole; and two elastic components disposed between the fixing base and the locking bolt;

wherein the screw bolt pushes the locking bolt upward into the fixing slot of the gun when the rotatable disk is rotated in a first direction; and the locking bolt is pushed downward by the two elastic components and thus disconnected from the fixing slot of the gun when the rotatable disk is rotated in a second direction.

2. The fixing structure as claimed in claim 1, wherein the containing room has two sides formed with a pair of first directing tracks and the gun has a pair of second directing tracks corresponding to the pair of first directing tracks, and the fixing base is attached to the gun by using the first directing tracks together with the second directing tracks.

3. The fixing structure as claimed in claim 1, wherein the rotatable disk has multiple indentations formed thereon, the fixing structure further has a shaft, the rotatable disk is disposed rotatably between the bottom of the fixing base and the top of the scope by using the shaft, and an outer edge of the rotatable disk projects from two sides of the fixing base.

4. The fixing structure as claimed in claim 1, wherein the locking component has two ends, each end of the locking component has a sliding component disposed thereon, the containing room of the fixing base has two sides formed with sliding slots, and the sliding components disposed on the two ends of the locking component are located within the sliding slots and capable of being moved upward or downward therein.

5. The fixing structure as claimed in claim 1, wherein the two elastic components are springs.

6. The fixing structure as claimed in claim 1, wherein the two elastic components slip respectively on two poles projecting from an upper portion of two ends of the locking bolt, and lower ends of the two elastic components are placed on the upper portion of the locking bolt and upper ends of the elastic components abut against tops of depressions formed on the fixing base.

* * * * *